US007740997B2

(12) United States Patent
Bender et al.

(10) Patent No.: US 7,740,997 B2
(45) Date of Patent: Jun. 22, 2010

(54) PHOTORECEPTOR INCLUDING MULTI-BLOCK POLYMERIC CHARGE TRANSPORT MATERIAL AT LEAST PARTIALLY EMBEDDED WITHIN A CARBON NANOTUBE MATERIAL

(75) Inventors: Timothy P. Bender, Toronto (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 881 days.

(21) Appl. No.: 11/463,082

(22) Filed: Aug. 8, 2006

(65) Prior Publication Data

US 2008/0038648 A1 Feb. 14, 2008

(51) Int. Cl.
*G03G 5/047* (2006.01)

(52) U.S. Cl. ..... 430/58.7; 430/58.05; 430/59.6; 430/133; 399/159

(58) Field of Classification Search ..... 430/59.6, 430/58.05, 58.7, 133
See application file for complete search history.

(56) References Cited

U.S. PATENT DOCUMENTS

| | | | |
|---|---|---|---|
| 3,121,006 | A | 2/1964 | Middleton et al. |
| 4,050,935 | A | 9/1977 | Limburg et al. |
| 4,281,054 | A | 7/1981 | Horgan et al. |
| 4,297,425 | A | 10/1981 | Pai et al. |
| 4,298,697 | A | 11/1981 | Baczek et al. |
| 4,338,390 | A | 7/1982 | Lu |
| 4,415,640 | A | 11/1983 | Goto et al. |
| 4,560,635 | A | 12/1985 | Hoffend et al. |
| 4,599,286 | A | 7/1986 | Limburg et al. |
| 4,801,517 | A | 1/1989 | Frechet et al. |
| 4,806,443 | A | 2/1989 | Yanus et al. |
| 4,806,444 | A | 2/1989 | Yanus et al. |
| 4,818,650 | A | 4/1989 | Limburg et al. |
| 4,935,487 | A | 6/1990 | Yanus et al. |
| 4,956,440 | A | 9/1990 | Limburg et al. |
| 5,030,532 | A | 7/1991 | Limburg et al. |
| 5,302,478 | A | 4/1994 | Springnett |
| 5,336,577 | A | 8/1994 | Spiewak et al. |
| 5,681,679 | A | 10/1997 | Schank et al. |
| 5,702,854 | A | 12/1997 | Schank et al. |
| 5,976,744 | A | 11/1999 | Fuller et al. |

FOREIGN PATENT DOCUMENTS

| | | | |
|---|---|---|---|
| DE | 25 50 630 | A | 5/1977 |

(Continued)

OTHER PUBLICATIONS

English language machine translation of JP 200-267317 (Sep. 2000).*

(Continued)

*Primary Examiner*—Christopher RoDee
(74) *Attorney, Agent, or Firm*—Oliff & Berridge, PLC

(57) ABSTRACT

An electrophotographic imaging member includes a substrate, a photogenerating layer, and an optional overcoating layer, where the photogenerating layer includes a multi-block polymeric charge transport material at least partially embedded within a carbon nanotube material.

23 Claims, 1 Drawing Sheet

FOREIGN PATENT DOCUMENTS

| | | | | |
|---|---|---|---|---|
| EP | 0 368 252 | A | | 5/1990 |
| EP | 0 896 975 | A | | 2/1999 |
| EP | 1 286 224 | A1 | | 2/2003 |
| FR | 2 254 441 | | | 7/1975 |
| JP | A-58-025639 | | | 2/1983 |
| JP | A-62-108259 | | | 5/1987 |
| JP | 2000267317 | A | * | 9/2000 |
| JP | A-2006-084987 | | | 3/2006 |

OTHER PUBLICATIONS

T. Durkop et al., "Extraordinary Mobility in Semiconducting Carbon Nanotubes," Nano. Lett., vol. 4, No. 1, 35-39 (2004).

L. Cao et al., "Photoconductivity study of modified carbon nanotube/oxotitanium phthalocyanine composites" Journal of Physical Chemistry, vol. 106, Aug. 7, 2002, pp. 8971-8975.

* cited by examiner

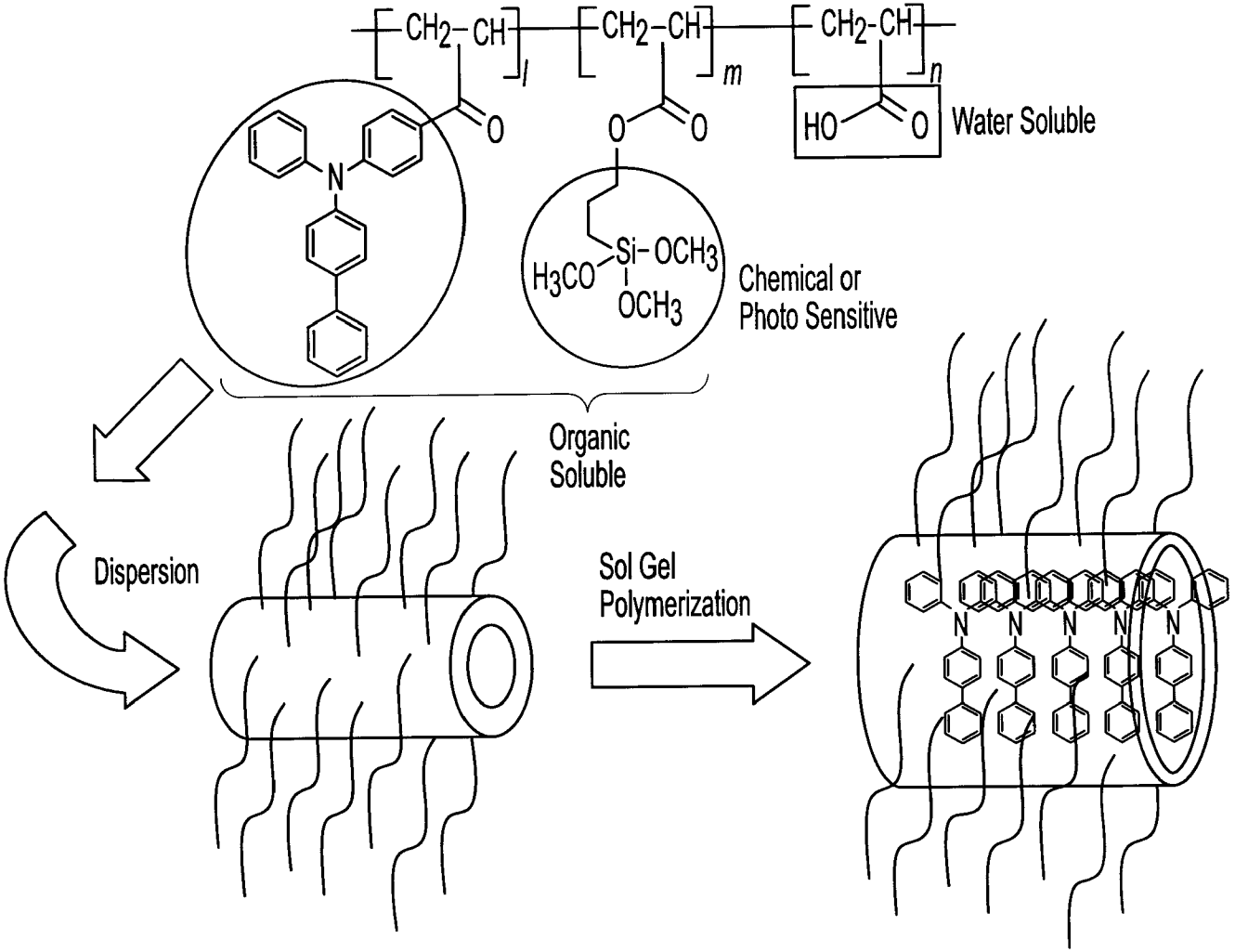
Water Soluble
Chemical or
Photo Sensitive
Organic
Soluble
Sol Gel
Polymerization
Dispersion

PHOTORECEPTOR INCLUDING MULTI-BLOCK POLYMERIC CHARGE TRANSPORT MATERIAL AT LEAST PARTIALLY EMBEDDED WITHIN A CARBON NANOTUBE MATERIAL

TECHNICAL FIELD

This disclosure is generally directed to electrophotographic imaging members and, more specifically, to layered photoreceptor structures comprising a charge transport layer that comprises multi-block polymeric charge transport materials at least partially embedded within carbon nanotube materials. This disclosure also relates to processes for making and using the imaging members.

RELATED APPLICATIONS

Commonly assigned U.S. patent application Ser. No. 11/463,050, filed concurrently herewith, describes an electrophotographic imaging member comprising: a substrate, an optional intermediate layer, a photogenerating layer, and an optional overcoating layer wherein the photogenerating layer comprises a carbon nanotube material.

Commonly assigned U.S. patent application Ser. No. 11/463,048, filed concurrently herewith, describes an electrophotographic imaging member comprising: a substrate, a photogenerating layer, and an optional overcoating layer wherein the photogenerating layer comprises a chemically functionalized carbon nanotube material.

Commonly assigned U.S. patent application Ser. No. 11/463,118, filed concurrently herewith, describes an electrophotographic imaging member comprising: a substrate, a photogenerating layer, and an optional overcoating layer wherein the photogenerating layer comprises a self-assembled carbon nanotube material having pendant charge transport materials.

The appropriate components and process aspects of each of the foregoing, such as the photoreceptor materials and processes, may be selected for the present disclosure in embodiments thereof. The entire disclosures of the above-mentioned applications are totally incorporated herein by reference.

REFERENCES

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

U.S. Pat. No. 4,297,425 discloses a layered photosensitive member comprising a generator layer and a transport layer containing a combination of diamine and triphenyl methane molecules dispersed in a polymeric binder.

U.S. Pat. No. 4,050,935 discloses a layered photosensitive member comprising a generator layer of trigonal selenium and a transport layer of bis(4-diethylamino-2-methylphenyl) phenylmethane molecularly dispersed in a polymeric binder.

U.S. Pat. No. 4,281,054 discloses an imaging member comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 4,415,640 discloses a single layered charge generating/charge transporting light sensitive device. Hydrazone compounds, such as unsubstituted fluorenone hydrazone, may be used as a carrier-transport material mixed with a carrier-generating material to make a two-phase composition light sensitive layer. The hydrazone compounds are hole transporting materials but do not transport electrons.

U.S. Pat. No. 5,336,577 discloses an ambipolar photoresponsive device comprising: a supporting substrate; and a single organic layer on said substrate for both charge generation and charge transport, for forming a latent image from a positive or negative charge source, such that said layer transports either electrons or holes to form said latent image depending upon the charge of said charge source, said layer comprising a photoresponsive pigment or dye, a hole transporting small molecule or polymer and an electron transporting material, said electron transporting material comprising a fluorenylidene malonitrile derivative; and said hole transporting polymer comprising a dihydroxy tetraphenyl benzidine containing polymer.

Japanese Patent Application Publication No. 2006-084987 describes a photoconductor for electrophotography, characterized by an undercoating layer containing a carbon nanotube.

The disclosures of each of the foregoing patents and applications are hereby incorporated by reference herein in their entireties. The appropriate components and process aspects of the each of the foregoing patents may also be selected for the present compositions and processes in embodiments thereof.

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and other materials. In addition, the imaging member may be layered in which each layer making up the member performs a certain function. Current layered organic imaging members generally have at least a substrate layer and two electro or photo active layers. These active layers generally include (1) a charge generating layer containing a light-absorbing material, and (2) a charge transport layer containing charge transport molecules or materials. These layers can be in a variety of orders to make up a functional device, and sometimes can be combined in a single or mixed layer. The substrate layer may be formed from a conductive material. Alternatively, a conductive layer can be formed on a nonconductive inert substrate by a technique such as but not limited to sputter coating.

The charge generating layer is capable of photogenerating charge and injecting the photogenerated charge into the charge transport layer or other layer.

In the charge transport layer, the charge transport molecules may be in a polymer binder. In this case, the charge transport molecules provide hole or electron transport properties, while the electrically inactive polymer binder provides mechanical properties. Alternatively, the charge transport layer can be made from a charge transporting polymer such as a vinyl polymer, polysilylene or polyether carbonate, wherein the charge transport properties are chemically incorporated into the mechanically robust polymer.

Imaging members may also include a charge blocking layer(s) and/or an adhesive layer(s) between the charge generating layer and the conductive substrate layer. In addition, imaging members may contain protective overcoatings. These protective overcoatings can be either electroactive or inactive, where electroactive overcoatings are generally preferred. Further, imaging members may include layers to provide special functions such as incoherent reflection of laser light, dot patterns and/or pictorial imaging or subbing layers to provide chemical sealing and/or a smooth coating surface.

Imaging members are generally exposed to repetitive electrophotographic cycling, which subjects the exposed charge transport layer or alternative top layer thereof to mechanical abrasion, chemical attack and heat. This repetitive cycling leads to a gradual deterioration in the mechanical and electrical characteristics of the exposed charge transport layer.

Although excellent toner images may be obtained with multilayered belt or drum photoreceptors, it has been found that as more advanced, higher speed electrophotographic copiers, duplicators and printers are developed, there is a greater demand on print quality. A delicate balance in charging image and bias potentials, and characteristics of the toner and/or developer, must be maintained. This places additional constraints on the quality of photoreceptor manufacturing, and thus, on the manufacturing yield.

Despite the various approaches that have been taken for forming imaging members, there remains a need for improved imaging member design, to provide improved imaging performance, longer lifetime, and the like.

SUMMARY

This disclosure addresses some or all of the above problems, and others, by providing imaging members where the charge transport layer includes multi-block polymeric charge transport materials at least partially embedded within carbon nanotube materials.

In an embodiment, the present disclosure provides an electrophotographic imaging member comprising:

a substrate, a photogenerating layer, and an optional overcoating layer wherein the photogenerating layer comprises a multi-block polymeric charge transport material at least partially embedded within a carbon nanotube material.

In another embodiment, the present disclosure provides a process for forming an electrophotographic imaging member comprising:

providing an electrophotographic imaging member substrate, and applying a photogenerating layer over the substrate, wherein the photogenerating layer comprises a multi-block polymeric charge transport material at least partially embedded within a carbon nanotube material.

The present disclosure also provides electrographic image development devices comprising such electrophotographic imaging members. Also provided are imaging processes using such electrophotographic imaging members.

BRIEF DESCRIPTION OF THE DRAWINGS

The FIGURE is a schematic depiction of multi-block polymeric charge transport materials at least partially embedded within carbon nanotube materials.

EMBODIMENTS

Electrophotographic imaging members are known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a hole or charge transport layer is formed on the charge generation layer, followed by an optional overcoat layer. This structure may have the charge generation layer on top of or below the hole or charge transport layer. In embodiments, the charge generating layer and hole or charge transport layer can be combined into a single active layer that performs both charge generating and hole transport functions.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer known in the art may be utilized. Typical adhesive layer materials include, for example, polyesters, polyurethanes, and the like. Satisfactory results may be achieved with adhesive layer thickness of about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and hole or charge transport functions as is known in the art or it may comprise multiple layers such as a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, such as from about 20 percent by volume to about 30 percent by volume of the photogenerating pigment dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also be fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer comprises multi-block polymeric charge transport materials at least partially embedded within carbon nanotube materials. For example, the multi-block polymeric charge transport material can include at least a charge transport block and a non-charge transport block, where one of the charge transport block and the non-charge transport block is embedded within the carbon nanotube materials but the other block is not embedded within the carbon nanotube materials. The non-charge transport block can be, for example, a block that assists in (such as increases) water solubility, a block that assists in (such as increases) organic solvent solubility, or a block that is responsive to chemical, photo, or physical stimuli to "lock" the material in place in relation to the carbon nanotube material. Of course, multiple non-charge transport blocks can also be included, such as to provide multiple of the above properties. Alternatively, a single non-charge transport block can be used that provides multiple of the above properties.

In embodiments, the carbon nanotube material comprises carbon nanotubes, carbon nanofibers, or variants thereof. As the carbon nanotube material, any of the currently known or after-developed carbon nanotube materials and variants can be used. Thus, for example, the carbon nanotubes can be on the order of from about 0.1 to about 50 nanometers in diameter, such as about 1 to about 10 nanometers in diameter, and up to hundreds of micrometers or more in length, such as from about 0.01 or about 10 or about 50 to about 100 or about 200 or about 500 micrometers in length. The carbon nanotube materials can be in multi-walled or single-walled forms, or a mixture thereof. In some embodiments, the carbon nanotube materials are particularly of the single-walled form. The carbon nanotubes can be either conducting or semi-conducting, with conducting nanotubes being particularly useful in embodiments. Variants of carbon nanotubes include, for example, nanofibers, and are encompassed by the term "carbon nanotube materials" unless otherwise stated.

In addition, the carbon nanotubes of the present disclosure can include only carbon atoms, or they can include other atoms such as boron and/or nitrogen, such as equal amounts of born and nitrogen. Examples of carbon nanotube material variants thus include boron nitride, bismuth and metal chalcogenides. Combinations of these materials can also be used, and are encompassed by the term "carbon nanotube materials" herein. In embodiments, the carbon nanotube material is desirably free, or essentially free, of any catalyst material used to prepare the carbon nanotubes. For example, iron catalysts or other heavy metal catalysts are typically used for carbon nanotube production. However, it is desired in embodiments that the carbon nanotube material not include any residual iron or heavy metal catalyst material.

To provide desired charge transport, solubility, and other properties, the carbon nanotube materials are permanently ordered with multi-block polymers that include at least one charge transport block and at least one non-charge transport block. In embodiments, the separate block units of the multi-block polymers can be randomly scattered along the polymer chain, although an ordered multi-block polymer is desired so that the at least one charge transport block and at least one non-charge transport block can be desirably located with respect to the carbon nanotube materials. The multi-block polymers can include, for example from 2 to about 10 or more different types of monomer units, such as 2, 3, 4, or 5 different types of monomer units.

In embodiments, the different types of monomer units can be variously located in the multi-block polymer chain with respect to the carbon nanotube material. For example, the different types of monomer units can be variously located either inside or outside of the carbon nanotube material. However, in one embodiment, the multi-block polymer is provided such that the charge transport block is located inside the carbon nanotube material, to provide increased charge transport properties, while the non-charge transport block or blocks are located outside of the carbon nanotube material, to provide, for example, increased solubility properties.

The multi-block polymers are permanently ordered with the carbon nanotube materials. That is, for example, rather than simply being physically associated with the carbon nanotube materials, the multi-block polymers are chemically or otherwise attached or anchored to the carbon nanotube materials. In this manner, for example, the charge transport blocks are localized in the carbon nanotube materials to provide the increased charge transport properties, without a likelihood that the charge transport moieties will move within the structure and thus alter the charge transport properties. Alternatively, in embodiments, the charge transport blocks can be localized, such as attached, on the outer surface of the carbon nanotube materials to provide the same increased charge transport properties.

The permanent ordering of the multi-block polymers with the carbon nanotube materials can be achieved in any suitable manner, so long as the multi-block polymers are locked or "frozen" into place with respect to the carbon nanotube materials. This permanent ordering can be achieved, for example, by any of the various chemical, photo, or physical means that anchor the multi-block polymers to the carbon nanotube materials.

At least one block of the multi-block polymer is a charge transport block. Suitable charge transport polymers containing charge transport blocks include, for example, polyvinylcarbazoles, polythiophenes, polysilanes, polyanilines, poly (phenylene vinylenes), polyphenylenes, poly(phenylene sulfides), polyanilines, poly(phenylene sulfide phenylenamine), copolymers thereof containing triarylamine charge transport groups, and mixtures thereof. In an embodiment, the arylamine charge transport compound is a para-subsbtuted arylamine charge transport material. Such arylamine charge transport material may commonly have from 1 to about 10 nitrogen centers per repeating unit, however in embodiments the arylamine charge transport material may have about 1 to about 6, such as about 1 and about 2 nitrogen centers per repeating unit. Where there is more than 1 nitrogen atom, the nitrogen atoms generally are covalently linked by carbon residues, which are considered aromatic such that there is an electronic connection at an atomic or molecular level between the nitrogen atoms. Of course, such attachment is desired in embodiments, but is not necessary. Other suitable charge transport blocks for the multi-block polymers are described in, for example, U.S. Pat. Nos. 4,806,443, 4,806,444, 4,818,650, 4,935,487, 4,956,440, 4,801,517, 4,806,444, 4,818,650, 4,806,443, and 5,030,532, the entire disclosures of which are incorporated herein by reference.

At least one other block of the multi-block polymer is a non-charge transport block. The non-charge transport block can be, for example, a block that assists in (such as increases) water solubility, a block that assists in (such as increases) organic solvent solubility, a block that is responsive to chemical, photo, or physical stimuli to "lock" the material in place in relation to the carbon nanotube material, or the like. The non-charge transport block can also provide multiple of these properties, if desired.

For example, the multi-block polymer cane include a non-charge transport block that is responsive to chemical or photo stimulus, and which is also at the same time soluble in organic materials. Examples of chemical and photo stimulus include, for example, ability to cure by radiation exposure such as UV-radiation exposure; ability to react such as through a sol-gel process, a hydrosilation reaction such as hydrosilation of a vinyl groups with a hydridosilane, a peroxide activated cure reaction such as of a vinyl group, by a sol-gel reaction; or the like.

Accordingly, exemplary non-charge transport blocks in this category include groups that are subject to sol-gel reaction, such as groups that include alkylsiloxy groups, silanol groups, chlorosilane groups, and the like. Such groups can undergo a sol-gel reaction with, for example, an alkoxysilane, a chlorosilane, a silanol-terminated polysiloxane, or the like. In the case of alkylsiloxy and alkoxysilane groups, the alkyl group can be, for example, from 1 to about 30 carbons in length, such as from 1 to about 20 or from 1 to about 10, such as 1, 2, 3, 4, or 5, and can be cyclic, straight, or branched. The group can also be substituted or unsubstituted, where the substitutions can include one or more groups selected from the group consisting of methyl, ethyl, isobutyl, isooctyl, cyclopentyl, cyclohexyl, vinyl, styrl, trimethylsiloxyl, trichlorosilylethyl, trichlorosilylpropyl, dichiorosilylethyl, chlorosilylethyl, phenyl, chlorobenzyl, cyanoethyl, cyanopropyl, norbomenyl, fluoro, silanol, dimethylsilane, alkoxy, methacrylate, silane, aniline, amine, phenol, and alcohol.

Other exemplary non-charge transport blocks in this category include groups that are subject to curing, such as by ultraviolet radiation. Exemplary radiation-curable groups thus include acrylates; methacrylates; alkenes; allylic ethers; vinyl ethers; epoxides, such as cycloaliphatic epoxides, aliphatic epoxides, and glycidyl epoxides; oxetanes; stilbenes, derivatives of cinnamic acid such as esters or amides of cinnamic acid and the like, which can be provided in the form of acrylated esters, acrylated polyesters, acrylated ethers, acrylated polyethers, acrylated epoxies, urethane acrylates, pentaerythritol tetraacrylate, acrylated cinnamic acid and the like. Specific examples of suitable acrylated monomers include, but are not limited to, polyacrylates, such as trimethylol propane triacrylate, pentaerythritol tetraacrylate, pentaerythritol triacrylate, dipentaerythritol pentaacrylate, glycerol propoxy triacrylate, tris(2-hydroxyethyl) isocyanurate triacrylate, pentaacrylate ester, and the like, epoxy acrylates, urethane acrylates, amine acrylates, acrylic acrylates, and the like.

Other exemplary non-charge transport blocks that can be used include blocks that assist in (such as increases) water solubility. Examples of such blocks include carboxylic acid groups, such as those having from 1 to about 20 carbon atoms, such as from 1 to about 15 or from 1 to about 10 carbon atoms. The block can have one or more carboxylic acid functionalities, such as 1, 2, 3, 4, or more carboxylic acid functionalities. Other examples of blocks that assist in water solubility or an increase in hydrophillicity are hydroxyl or sulfonic acid residues where said residues contain aliphatic or aromatic residues containing 1 to about 20 carbon atoms, such as from 1 to about 15 or from 1 to about 10 carbon atoms. The block can have one or more hydrophilic functionality, such as 1, 2, 3, 4, or more hydrophilic functionalities.

In one embodiment, the multi-block polymer includes charge transport blocks, sol-gel functional non-charge transport blocks, and water soluble non-charge transport blocks. Such a multi-block polymer can generally be represented by the formula:

$$(CTB)_a(NCTB1)_b(NCTB2)_c$$

where CTB represents the charge transport block, NCTB1 represents the sol-gel functional non-charge transport blocks, NCTB2 represents the water soluble non-charge transport blocks, and a, b, and c represent average number of monomer units. In embodiments, the subscripts a, b, and c in the above formula can be, for example, each in a range of from about 1 to about 98, such as in a ratio of a:b:c varying from about 1:1:98 to 1:98:1 to 98:1:1 depending on the nature of the multi-block polymer and the desired application. Additionally the total multi-block polymer may have a molecular weight as low as about 1,000 Daltons to as high as about 1,000,000 Daltons, again depending on the nature of the multi-block polymer and its intended application.

The FIGURE represents, schematically, only one exemplary embodiment. In the schematic, multi-block polymers generally of the formula above is permanently ordered with a carbon nanotube. As shown in the figure, the charge transport block of the multi-block polymer is located inside the carbon nanotube, while the sol-gel functional non-charge transport block and the water soluble non-charge transport block are both located outside of the carbon nanotube. The morphology of the components is then locked-in, or frozen, by a sol-gel reaction with the sol-gel functional non-charge transport blocks.

The multi-block polymer and carbon nanotube material structure can be used in place of, or in addition to, conventional charge transport materials in the charge transport layer. When the multi-block polymer and carbon nanotube material structure is used in addition to convention charge transport materials, the convention charge transport materials can be, for example, charge transporting small molecules dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. Any suitable charge transporting or electrically active small molecule may be employed in the charge transport layer. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. Small molecule charge transporting compounds that permit injection of holes from the pigment into the charge generating layer with high efficiency and transport them across the charge transport layer with very short transit times are N,N'-diphenyl-N,N'-bis(3-methylphenyl)-(1,1'-biphenyl)-4,4'-diamine, N,N,N',N'-tetra-p-tolylbiphenyl-4,4'-diamine, and N,N'-Bis(3-methylphenyl)-N,N'-bis[4-(1-butyl)phenyl]-[p-terphenyl]-4,4'-diamine.

The charge transport layer of the photoreceptor can include the multi-block polymer and carbon nanotube material structure in any desired and suitable amount.

A benefit of the use of multi-block polymeric charge transport materials at least partially embedded within carbon nanotube materials in charge transport layers is that the materials exhibit very high charge transport mobility. Accordingly, the use of multi-block polymeric charge transport materials at least partially embedded within carbon nanotube materials in a charge transport layer can provide charge transport speeds that are orders of magnitude higher than charge transport speeds provided by conventional charge transport materials. For example, the charge transport mobility in a charge transport layer comprising multi-block polymeric charge transport materials at least partially embedded within carbon nanotube materials can be 1, 2, 3, 4, 5, 6, 7, or more, such as about 1 to about 4, orders of magnitude higher as compared to a comparable charge transport layer that includes a similar amount of conventional pyrazoline, diamine, hydrazones, oxadiazole, or stilbene charge transport small molecules. This resultant dramatic increase in charge mobility can result in significant corresponding improvements in the printing process and apparatus, such as extreme printing speeds, increased print quality, and increased photoreceptor reliability.

Additional details regarding carbon nanotubes and their charge transport mobilities can be found, for example, in T. Durkop et al., "Extraordinary Mobility in Semiconducting Carbon Nanotubes," Nano. Lett., Vol. 4, No. 1, 35-39 (2004), the entire disclosure of which is incorporated herein by reference.

Any suitable electrically inactive resin binder insoluble in the alcohol solvent used to apply an optional overcoat layer may be employed in the charge transport layer. Typical inactive resin binders include polycarbonate resin, polyester, polyarylate, polysulfone, and the like. Molecular weights can vary, for example, from about 20,000 to about 150,000. Exemplary binders include polycarbonates such as poly(4,4'-isopropylidene-diphenylene)carbonate (also referred to as bisphenol-A-polycarbonate, poly(4,4'-cyclohexylidine-diphenylene) carbonate (referred to as bisphenol-Z polycarbonate), poly(4,4'-isopropylidene-3,3'-dimethyl-diphenyl) carbonate (also referred to as bisphenol-C-polycarbonate) and the like. Any suitable charge transporting polymer may also be utilized in the charge transporting layer. The charge transporting polymer should be insoluble in any solvent employed to apply the subsequent overcoat layer described below, such as an alcohol solvent. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layers is desirably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

To improve photoreceptor wear resistance, a protective overcoat layer can be provided over the photogenerating layer (or other underlying layer). Various overcoating layers are known in the art, and can be used as long as the functional properties of the photoreceptor are not adversely affected.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrophotographic imaging member comprising:

a substrate, a photogenerating layer, and an optional overcoating layer wherein the photogenerating layer comprises a multi-block polymeric charge transport material at least partially attached to a surface of a carbon nanotube material, and the multi-block polymeric charge transport material comprises a charge transport block and a non-charge transport block, wherein the charge transport block is attached to the surface of the carbon nanotube material.

2. The electrophotographic imaging member of claim 1, wherein the photogenerating layer comprises a charge generating layer and a separate charge transport layer, and the charge transport layer comprises the multi-block polymeric charge transport material at least partially attached to the surface of the carbon nanotube material.

3. The electrophotographic imaging member of claim 1, wherein said carbon nanotube material is in a form of single wall carbon nanotubes.

4. The electrophotographic imaging member of claim 1, wherein said carbon nanotube material is selected from the group consisting of materials containing only carbon atoms, and materials containing carbon atoms and equal amounts of boron and nitrogen.

5. The electrophotographic imaging member of claim 1, wherein the non-charge transport block is selected from the group consisting of a block that increases water solubility of the multi-block polymeric charge transport material, a block that increases organic solvent solubility of the multi-block polymeric charge transport material, and a block that is responsive to chemical, photo, or physical stimuli to lock the material in place in relation to the carbon nanotube material.

6. The electrophotographic imaging member of claim 1, wherein the charge transport block comprises an arylamine charge transport compound.

7. The electrophotographic imaging member of claim 6, wherein the arylamine charge transport compound comprises from 1 to about 10 nitrogen atoms per repeating unit.

8. The electrophotographic imaging member of claim 1, wherein the non-charge transport block comprises a group that is subject to sol-gel reaction, selected from the group consisting of alkylsiloxy groups, silanol groups, and chlorosilane groups.

9. The electrophotographic imaging member of claim 1, wherein the non-charge transport block comprises a group that is subject to radiation-induced curing, selected from the group consisting of acrylates, methacrylates, alkenes, allylic ethers, vinyl ethers, epoxides, and oxetanes.

10. The electrophotographic imaging member of claim 1, wherein the non-charge transport block comprises:

a first non-charge transport block that is responsive to chemical, photo, or physical stimuli to lock the material in place in relation to the carbon nanotube material, and a second non-charge transport block that increases water solubility, and is selected from the group consisting of carboxylic acid groups.

11. The electrophotographic imaging member of claim 1, wherein the multi-block polymeric charge transport material is permanently ordered with the carbon nanotube material by at least one of curing by radiation exposure, reaction through a sol-gel process, reaction through a hydrosilation reaction, and reaction through a peroxide activated cure reaction.

12. The electrophotographic imaging member of claim 1, wherein said carbon nanotube material is from about 0.1 to about 50 nanometers in diameter and from about 1 to about 500 micrometers in length.

13. The electrophotographic imaging member of claim 1, wherein said multi-block polymeric charge transport material at least partially embedded within a carbon nanotube material is present in an amount of from about 0.5 to about 60 percent by weight of the photogenerating layer.

14. The electrophotographic imaging member of claim 1, wherein the substrate is selected from the group consisting of a layer of electrically conductive material or a layer of electrically non-conductive material having a surface layer of electrically-conductive material.

15. The electrophotographic imaging member of claim 1, wherein the substrate is in a form of an endless flexible belt, a web, a rigid cylinder, or a sheet.

16. The electrophotographic imaging member of claim 1, further comprising at least one of a hole blocking layer and an adhesive layer, between said substrate and said photogenerating layer.

17. The electrophotographic imaging member of claim 1, wherein the charge generating layer comprises a film-forming binder and a charge generating material.

18. The electrophotographic imaging member of claim 1, wherein the photogenerating layer further comprises a film-forming binder selected from the group consisting of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and mixtures thereof.

19. A process for forming an electrophotographic imaging member comprising:

providing an electrophotographic imaging member substrate, and applying a photogenerating layer over the substrate, wherein the photogenerating layer comprises a multi-block polymeric charge transport material at least partially attached to a surface of a carbon nanotube material, and the multi-block polymeric charge transport material comprises a charge transport block and a non-charge transport block, wherein the charge transport block is attached to the surface of the carbon nanotube material.

20. The process of claim 19, wherein the applying comprises:

applying a charge generating layer over the substrate, and applying a charge transport layer over the charge generating layer, wherein the charge transport layer comprises the multi-block polymeric charge transport material at least partially attached to the surface of the carbon nanotube material.

21. The process of claim 20, wherein the applying the charge transport layer comprises applying a charge transport layer coating solution comprising a film-forming binder and the multi-block polymeric charge transport material at least partially attached to the surface of the carbon nanotube material to said substrate; and curing said charge transport layer coating solution to form said charge transport layer.

22. The process of claim 21, wherein the multi-block polymeric charge transport material at least partially attached to the surface of the carbon nanotube material is soluble in said charge transport layer coating solution.

23. An electrographic image development device, comprising an electrophotographic imaging member comprising:

a photogenerating layer, and an optional overcoating layer wherein the photogenerating layer comprises a multi-block polymeric charge transport material at least partially attached to a surface of a carbon nanotube material, and the multi-block polymeric charge transport material comprises a charge transport block and a non-charge transport block, wherein the charge transport block is attached to the surface of the carbon nanotube material.

* * * * *